US006311757B1

(12) United States Patent
Schuette et al.

(10) Patent No.: US 6,311,757 B1
(45) Date of Patent: Nov. 6, 2001

(54) DOOR OR GATE CLOSURE

(75) Inventors: Wolfgang Schuette, Anroechte; Milan Puncoh, Lippstadt, both of (DE)

(73) Assignee: Schieffer Tor-und Schutzsysteme GmbH, Lippstadt (DE)

( * ) Notice: Subject to any disclaimer, the term of this patent is extended or adjusted under 35 U.S.C. 154(b) by 0 days.

(21) Appl. No.: 09/485,580

(22) PCT Filed: Jul. 30, 1998

(86) PCT No.: PCT/EP98/04780

§ 371 Date: Jun. 14, 2000

§ 102(e) Date: Jun. 14, 2000

(87) PCT Pub. No.: WO99/09286

PCT Pub. Date: Feb. 25, 1999

(30) Foreign Application Priority Data

Aug. 14, 1997 (DE) ..... 297 14 615 U

(51) Int. Cl.[7] ..... E05D 15/16
(52) U.S. Cl. ..... 160/202; 160/189
(58) Field of Search ..... 160/201, 202, 160/189, 193, 197, 188, 32, 34, 36

(56) References Cited

U.S. PATENT DOCUMENTS

| | | | | |
|---|---|---|---|---|
| 1,462,645 | | 7/1923 | Lancaster . | |
| 1,838,491 | | 12/1931 | Martin . | |
| 1,872,489 | * | 8/1932 | Mitchell | 160/202 X |
| 2,339,569 | * | 1/1944 | Jackson | 160/202 |
| 2,339,570 | * | 1/1944 | Jackson | 160/202 |
| 2,574,760 | | 11/1951 | Rohrman | 268/59 |
| 2,841,390 | | 7/1958 | Urquhart | 268/51 |
| 3,079,989 | * | 3/1963 | Fentiman | 160/202 X |
| 3,103,246 | | 9/1963 | Brodsky | 160/188 |
| 3,304,994 | | 2/1967 | Kozak | 160/202 |
| 3,313,338 | | 4/1967 | Knight | 160/189 |
| 4,938,273 | | 7/1990 | Dubbelman et al. | 160/201 |
| 5,133,398 | * | 7/1992 | Yang et al. | 160/202 X |
| 5,685,355 | * | 11/1997 | Cook et al. | 160/202 |

* cited by examiner

*Primary Examiner*—David M. Purol
(74) *Attorney, Agent, or Firm*—Jacobson Holman, PLLC

(57) ABSTRACT

The invention relates to a door or gate closing mechanism having essentially rectangular closing elements disposed horizontally and in parallel to one another which are movable in manner overlapping one another. The closing elements are driven in such a way that the second closing element is travelled at double the speed of the first and the third at three times the speed of the first and the last at a speed corresponding to the speed of the first closing element multiplied by the number of closing elements. Thus, only the bottom-most closing element is travelled over the full height at maximum drive speed during the opening or closing of the door while the remaining closing elements have to be travelled at a correspondingly lower speed over correspondingly shorter distances. In this way, overall a favourable energy balance is produced during the opening and closing of the door closing apparatus in accordance with the invention.

29 Claims, 8 Drawing Sheets

FIG. 4
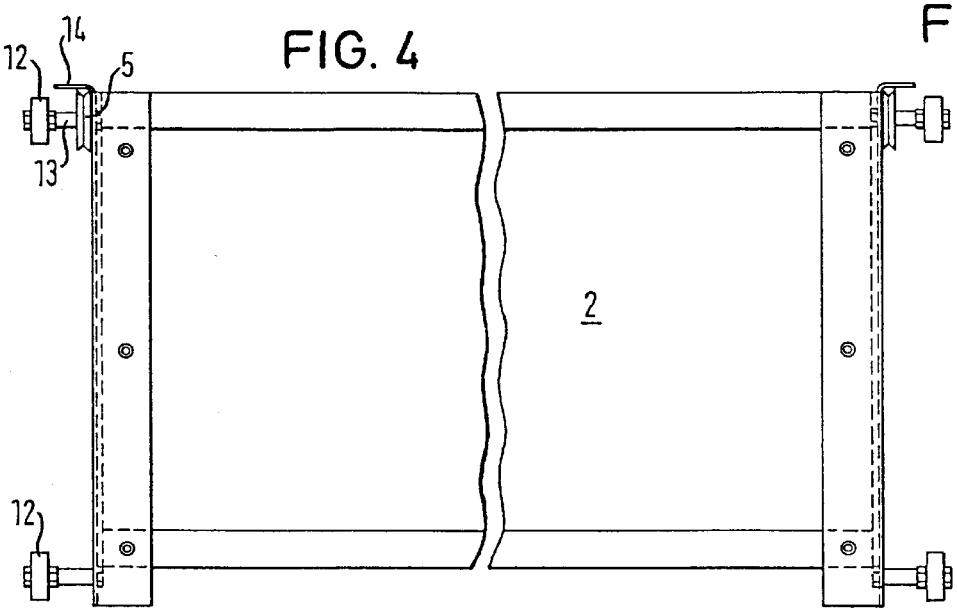
FIG. 5
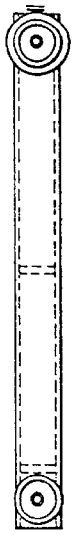
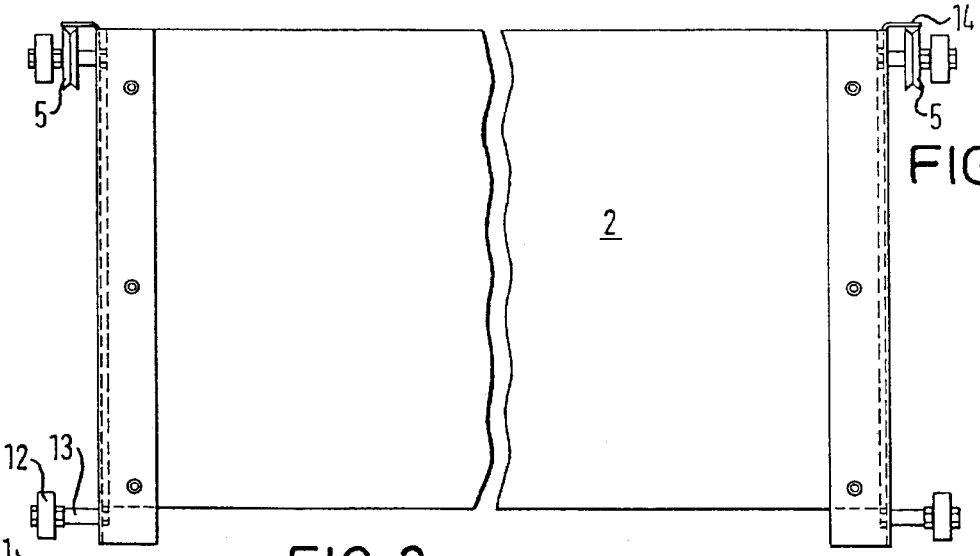
FIG. 3
FIG. 2
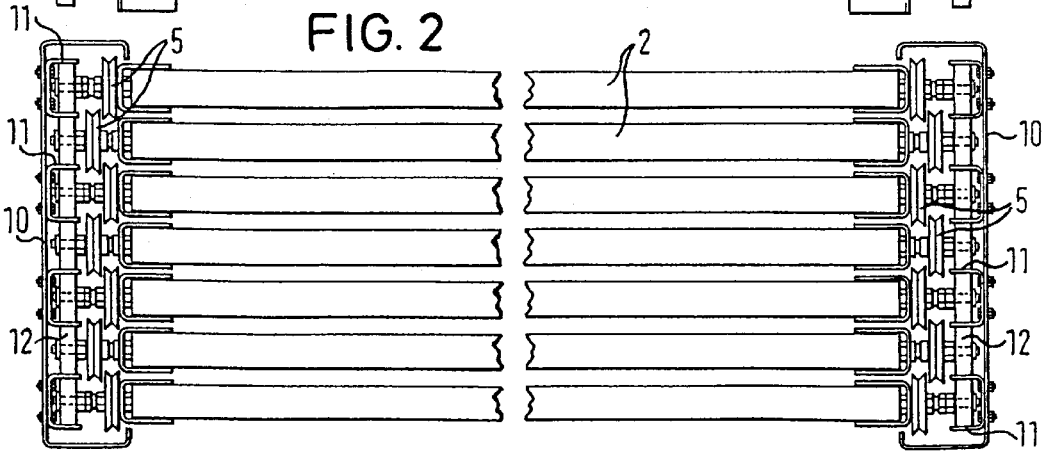

FIG. 16
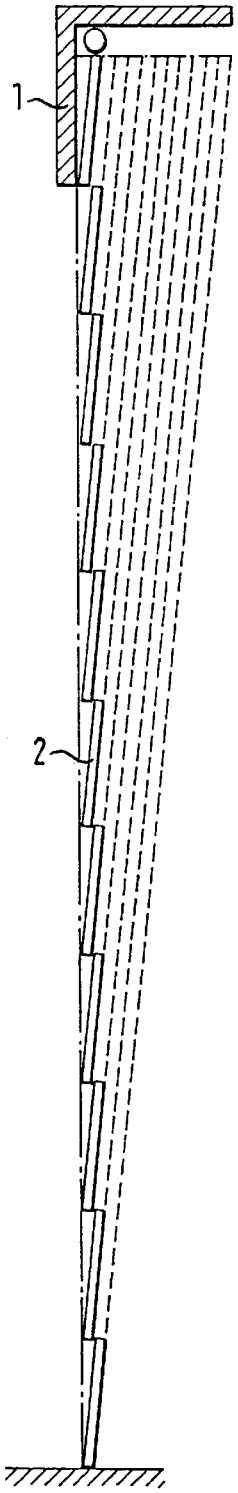
FIG. 15
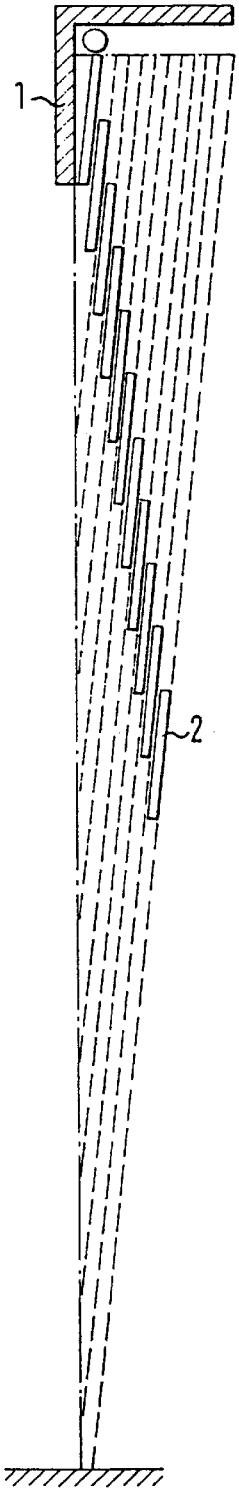
FIG. 14
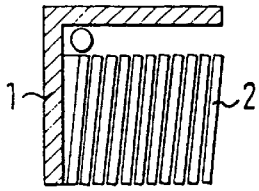
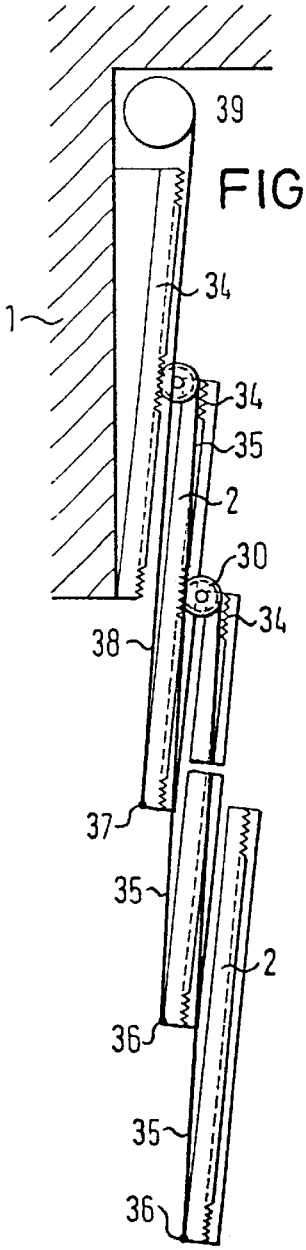
FIG. 13

DOOR OR GATE CLOSURE

BACKGROUND OF THE INVENTION

1. Field of the Invention

The invention relates to a door or gate closing apparatus.

2. Description of the Related Art

Door closing apparatuses for industrial doors, for example, are known in a variety of versions. They normally consist of a flexible door panel which can be wound up on a winding shaft supported in the upper frame section of the door and provided with a drive, the side ends of which door panel are guided in slits of the side door sections and the lower closing section of which is connected to ropes which tighten the door panel. Such door closing apparatuses have only a low stability due to their flexible door panel usually consisting of plastic.

Doors where the door panel which can be wound up on the winding shaft consists of strip-shaped closing elements which can be hinged together like Venetian blinds have a greater stability.

However, with door panels which can be wound up on winding shafts and which can be wound off same, the disadvantage exists that these have to be moved at the same speed during opening and closing, whereby the rotatory masses of the winding shaft, of the door panel section wound up thereon and of the drives are added to the translatorily moved masses so that a relatively unfavourable energy balance is produced.

SUMMARY OF THE INVENTION

It is the object of the invention to provide a door or gate closing apparatus which can be opened and closed quickly with masses moved at the lowest possible speed.

This object is solved in accordance with the invention by essentially rectangular plate-shaped closing elements disposed horizontally and in parallel to one another, which are guided in the region of the lateral door cross beams and movable relative to one another by a drive from an upper position, in which they lie next to each other roughly edgeways to their wide sides in a stack with essentially aligned side edges, to a lowered position, into which they are travelled with decreasing overlapping length and in which they still only overlap by their edge sections, and which are connected to the upper beam or closing section of the door and to one another by flexible tension or gear elements in such a way that the first closing element is lowered or raised relative to the closing section and neighbouring closing elements relative to each other at the same speed.

As the topmost plate-shaped or lamellar closing element is lowered or raised relative to the upper closing section and the following closing elements each relative to the preceding one both at the same speed, the second closing element is travelled at double the speed of the first and the third at three times the speed of the first and the last closing element at a speed corresponding to the speed of the first closing element multiplied by the number of closing elements. As, therefore, only the bottom-most closing element is travelled over the full height of the opening to be closed during the opening or closing of the door and the preceding closing elements at a correspondingly lower speed only over correspondingly shorter distances, overall a . . . masses . . . adding also the rotating masses of the winding shaft, of the section of the gate leaf and the drives, wound on said winding shaft, so that the result is a relatively poor energy balance.

The object of the invention is to provide a door or gate lock that can be quickly opened and closed, yet the masses move at the lowest possible speed.

The invention solves this problem by means of essentially rectangular, plate-shaped locking elements, which are arranged horizontally and parallel to each other. Said locking elements are guided in the region of the side gate rails and can be slid relative to each other by means of a drive out of an upper position, in which they lie, for example, on edge with respect to their wide sides, side by side with essentially aligned side edges in a stack, into a lowered position, into which they are moved with decreasing overlapping lengths and in which they overlap only with their edge regions. Said locking elements are connected in such a manner by means of flexible pull and/or drive elements to the upper beams or end profile of the gate and to each other that the first locking element is lowered and lifted relative to the end profile at the same speed and the adjacent locking elements are lowered and lifted relative to each other at the same speed.

Since the uppermost plate-shaped or lamellar locking element is lowered and lifted relative to the upper end profile at the same speed and the following locking elements are lowered and lifted relative to the respective preceding one at the same speed, the second locking element is moved at twice the speed of the first and the third at three times the speed of the first and the last locking element at a speed that is equivalent to the speed of the first locking element multiplied by the number of locking elements. Therefore, since upon opening and closing the gate the bottommost locking element is moved over the entire height of the aperture to be locked and the . . .

The U.S. Pat. No. 2,841,390 discloses a gate lock for wide and large apertures, such as the entrance aperture of airport hangars, factories and the like. In addition, there are several gate elements, which are arranged vertically and parallel to each other and can be slid sideways to each other. In this respect the right side of a first gate element can have, for example, a connecting cable that is guided over a roller on the right end of a neighboring gate element and is connected to the left end of a second gate element. . . . masses . . . adding also the rotating masses of the winding shaft, of the section of the gate leaf and the drives, wound on said winding shaft, so that the result is a relatively poor energy balance.

The object of the invention is to provide a door or gate lock which can be quickly opened and closed, yet the masses move at the lowest possible speed.

The invention solves this problem by means of essentially rectangular, plate-shaped locking elements, which are arranged horizontally and parallel to each other. Said locking elements are guided in the region of the side gate rails and can be slid relative to each other by means of a drive out of an upper position, in which they lie, for example, on edge with respect to their wide sides, side by side with essentially aligned side edges in a stack, into a lowered position, into which they are moved with decreasing overlapping lengths and in which they overlap only with their edge regions. Said locking elements are connected in such a manner by means of flexible pull and/or drive elements to the upper beams or end profile of the gate and to each other that the first locking element is lowered and lifted relative to the end profile at the same speed and the adjacent locking it elements are lowered and lifted relative to each other at the same speed.

Since the uppermost plate-shaped or lammelar locking element is lowered and lifted relative to the upper end profile at the same speed and the following locking elements are lowered and lifted relative to the respective preceding one at the same speed, the second locking element is moved at twice the speed of the first and the third at three times the speed of the first and the last locking element at a speed that is equivalent to the speed of the first locking element multiplied by the number of locking elements. Therefore, since upon opening and closing the gate the bottommost locking element is moved over the entire height of the aperture to be locked and the exising locking elements have to be moved only over the correspondingly shorter distance at a correspondingly lower speed, the result is altogether a positive energy balance when opening and closing the gate lock of the invention.

A preferred embodiment provides that segments of the flexible pull mechanisms proceed from a fixed point in the lower region of the upper end profile and fixed points in the bottom regions of the locking elements respectively, with the exception of the bottom locking element, over a deflecting roll in the upper region of the first locking element and in the upper region of the respective following locking elements to a fixed point in the bottom region of the respective second locking element. This edging into line of the segments of the flexible pull mechanisms produces the desired kinematics so that the locking elements, following the first locking element, are coupled in such a manner to the respective preceding locking element that, upon lowering and raising, the individual locking elements moved at the same speed relative to the preceding locking element.

A drive that raises and lowers the locking element engages with the upper locking element. The manner in which the locking elements are coupled together and to the upper end profile results in the uppermost locking element being lowered, thus all of the locking elements moving downward at the same speed under the influence of gravity and exhibiting the described kinematics. Inversely lifting the uppermost locking element by means of the drive results in all of the locking elements moving into the upper opening position in the region of the upper end profile.

The flexible pull mechanisms, by means of which the locking elements are connected together and the upper locking element is connected to the upper end profile, can consist of cables, belts or chains.

Appropriately, the drive consists of a toothed belt or a chain which runs over a toothed belt sprocket or chain sprocket of a geared motor disposed in the upper closing section.

In accordance with a preferred embodiment, it is provided that the toothed belt or chain strand side running off the belt sprocket or chain sprocket is connected to a spring in a fixed connection to the door in such a way that said spring is increasingly tightened as the closing elements are lowered. This design allows the closing elements travelled to their closing position to be travelled automatically at least partially into their open position by the spring after the release of the drive. In addition, said spring prevents the closing elements from falling down in an uncontrolled manner from their open position after any unintentional release of the drive.

Appropriately, the closing sections are provided on their top and bottom regions of their side edges with rollers which are guided in guides of the side cross beams or of the side door sections.

The guides can consist of metal sheets running parallel to one another, of which neighbouring sheets in each case form guides for the rollers of a closing element, The flexible tension means which raise and lower the closing elements and their drives are appropriately disposed in the side regions of the closing elements so that they are covered by the lateral door sections. Generally, it would be sufficient to provide the flexible tension means and the drive only once. To ensure a good and non-canting guide, however, they are appropriately both provided twice.

Appropriately, the guide pulleys are supported offset to one another from closing element to closing element on journals connected to the side edges of the closing elements. This disposition of the guide pulleys ensures that the crossing tension means can be led past each other without touching.

Appropriately, the guide pulleys are supported on the same journals supporting the rollers.

The closing elements can also be provided on their upper and lower ends with slide blocks which are guided in slide rails or provided with slits which encompass the guide bars. The slide blocks appropriately consist of a low-friction plastic.

In accordance with another aspect of the invention, it is provided that the guide pulleys are supported on oblique axles connected to the side edges of the closing elements. This disposition allows the guide pulleys to be disposed in the same way on all closing elements so that their median planes are in successive planes parallel to one another and that the flexible tension elements running over them can cross one another without impediment.

In accordance with another aspect of the invention, it is provided that two continuous flexible tension elements run in a crossing manner over the guide pulleys which tension elements are reversed over journals—which form the fixed points—fixed in the lower regions of the lateral narrow sides of the closing elements. In accordance with this aspect, a simpler edging into line of the flexible tension elements crossing one another is produced.

The flexible tension element which runs over the lower journal of the upper closing element can be connected to the toothed belt or chain driven by the geared motor.

In accordance with a further embodiment of the door or gate closing apparatus in accordance with the invention, it can be provided to provide beginning from a second fixed point of the lower closing element an identical edging into line of flexible tension elements, but in the opposite direction. In this aspect, the individual closing elements are forced to travel downwards when the upper closing element is moved downwards by the drive. In this aspect of the door or gate closing apparatus in accordance with the invention, it is therefore excluded that problems could arise due to friction when the closing elements are travelled downwards. To achieve a travelling downwards not exclusively under the effect of gravity, the drive engaging the top closing element could also consist of a pressure medium/piston/cylinder unit which can both raise and lower the top closing element.

If the individual closing elements are coupled in opposite directions by the flexible tension means and the guide pulleys, as is provided in the travelling upwards of the closing elements, the lower closing elements cannot be raised in a simple manner either in the closed state of the door so that then any locking of the lower closing element can be dispensed with, which locking is then appropriately provided when the individual closing elements are travelled into their closed position due to their gravity when the topmost closing element is let down.

If the individual closing elements have been edged into line in the manner described for travelling in two directions opposite to each other, they can also be disposed in a standing position vertically on their narrow sides so that a door or gate closing apparatus is produced in which the closing elements are moved beginning from one door side to the other or beginning from both door sides towards each other and away from each other.

In accordance with another embodiment of the invention, it is provided that at the upper end regions of the closing elements cogwheels having coaxial winding drums for flexible tension elements are freely pivoted from which the cogwheel of the top closing element meshes with a rack in a fixed position on the door and the cogwheels of the following closing elements mesh with racks which are each fixed to the preceding closing elements. With this type of coupling of the closing elements to one another and of the top closing element to the top closing section or the top region of the door, generally identical motion characteristics of the closing elements are achieved.

To give the following closing elements the same speed as the preceding ones, each winding drum, whose diameter is roughly the same as the pitch diameter of the cogwheel, possesses a spiral winding groove.

Each winding drum can also have lateral limit washers between which the flexible tension element is wound up in spiral fashion, with the centre of the height of the winding groove being roughly at the height of the pitch of the cogwheel.

The closing elements can consist of extruded sections.

Appropriately, the closing elements possess on their top and bottom longitudinal edges strips shaped as opposing hooks to hook into one another in a closed state. This hooking arrangement prevents the individual closing elements from being pushed away from their closed position by one another and, for example, rainwater from penetrating the gap between the individual closing elements.

Apart from the fact that a lower consumption of energy over conventional industrial doors is produced from the way in accordance with the invention of the travelling of the individual closing elements between their open and closed positions, the kinetic and potential energies which occur are more favourable. The kinetic energy is more favourable because only the lower closing element is moved at the highest speed and the speeds of the closing elements above it become lower by proportionate steps. As all door segments do not have to be moved over the full closing path, but rather by steps from the top to bottom only over a part of the closing path, the potential energy is also more favourable.

Finally, the door in accordance with the invention is also less dangerous if the lower closing element were to impact objects or persons, because this then impacts only with its mass and not also with the mass of all closing elements.

Due to the disposition of the closing elements travelled into the closed position as lying scale-like on top of one another or as in the form of roof tiles, the door in accordance with the invention also offers a good and specific appearance.

Embodiments of the invention are described in more detail below by means of the drawing in which

BRIEF DESCRIPTION OF THE DRAWINGS

FIG. 2 shows a top view of the closing elements travellable in their guides;

FIGS. 3 and 4 show a front view of the closing elements of FIG. 2;

FIG. 5 shows a side view of the closing element of FIG. 4;

FIG. 13 shows a side view of another embodiment of a door closing apparatus in a schematic representation;

FIG. 14 shows a side view of the door closing apparatus of FIG. 13 in which the closing elements are located in their open position;

FIG. 15 shows a side view of the door of FIG. 14 in which the closing elements are travelled into the semi-closed position;

FIG. 16 shows a representation of the door of FIG. 15 in which the closing elements are travelled to their closed position;

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
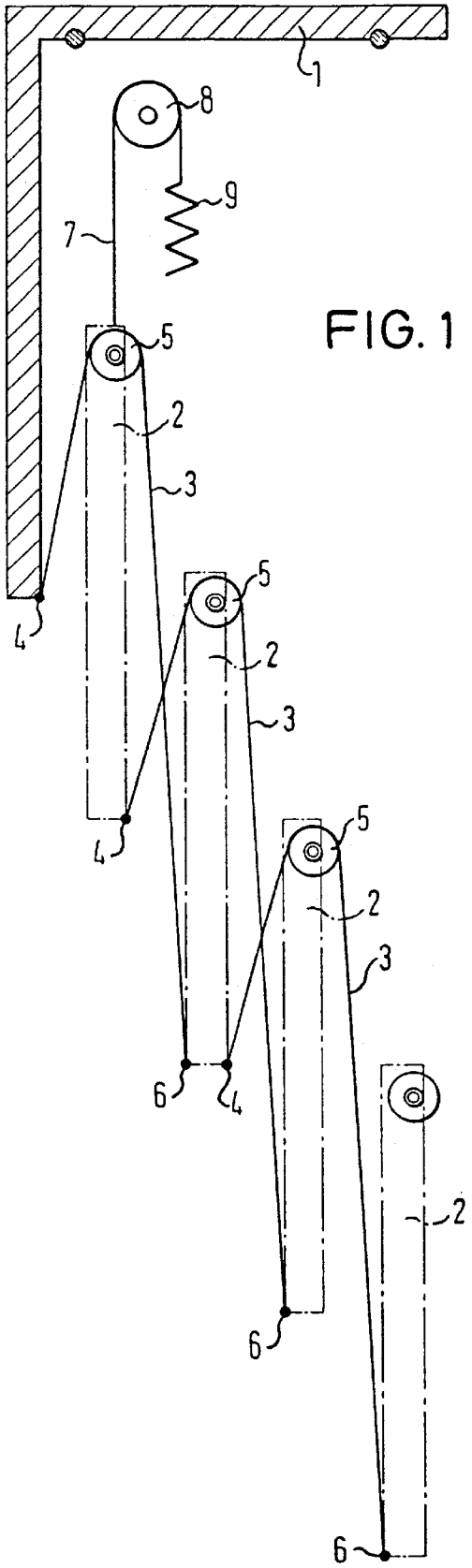
FIG. 1 shows a side view of a first embodiment of the door closing apparatus in a schematic representation.

FIG. 1 shows the schematically represented top closing section 1 of a door frame which closing section is connected to the side parts or side sections as a top cross beam.

In guides of the side parts of the door frame, closing elements 2 are guided essentially vertically movably which consist of flat, essentially rectangular elements. For reasons of simplicity, only four closing elements are shown in FIG. 1, while in accordance with the embodiment of FIGS. 2 and 7 to 9, seven closing elements 2 exist.

In FIG. 1, the closing elements 2 are shown in the exploded state in order to describe in more detail the type of edging into line of the ropes 3. The first rope 3 runs from a fixed point 4 in the side part of the door construction via a guide pulley 5, which is supported on a journal which is located in the upper region of the narrow side of the first closing element 2, to a fixed point 6 which is located in the lower end region of the next, that is second, closing element 2.

From the fixed point 4 in the lower end region of the first closing element 2, the rope 3 runs via the guide pulley 5 of the following closing element 2 to the fixed point 6 in the lower end region of the next-but-one, that is third, closing element 2.

From the lower fixed point 4 of the second closing element 2, the next rope 3 runs via the guide pulley 5 of the following, that is third, closing element 2 to the fixed point 6 at the lower end region of the next-but-one, that is fourth, closing element 2, and so on to the last closing element.

Fitted to the first closing element 2 is a link chain or a toothed belt 7 which runs over a chain sprocket or a toothed belt pulley 8 and whose strand side running off the toothed belt pulley 8 is fixed via a tension spring 9 to a point fixed in position on the frame. The toothed belt pulley 8 is the follower gear of a geared motor which lets down the closing elements 2 from their upper open position and raises them again from their closed position to the upper open position. As the closing elements 2 are lowered by the geared motor, the tension spring 9 is increasingly tightened. If the motor breaks down or is switched off, the tension spring tightened during the lowering of the closing elements can raise them again. At least, the tension spring 9 supports the possibility of pushing the closing elements back to their open position when the geared motor is switched off.

The lateral door sections 10 are visible in FIG. 2 which are screwed together by U sections whose legs 11 running vertically parallel to one another form guides for rollers 12 which are pivoted freely on side journals 13 which are fixed in the manner visible in FIGS. 2 to 4 to the upper and lower narrow sides of the closing elements. On the upper journals 13, the rollers 5 are additionally supported, over which the ropes 3 not shown in FIG. 2 run between the fixed points 4 and 6. The rollers 5 are disposed in the manner shown in FIGS. 2 to 4 in the side sections 10 in two planes alternately offset in relation to one another so that the ropes 3 can cross without impediment.

As can be seen from FIGS. 3 and 4, the closing elements 2 consist of plate-shaped elements which are encompassed on their sides by U-shaped sections.

In the closing element of FIG. 3 the rollers 5 are disposed further to the outside on the journals 13 and in the closing elements of FIG. 4 further to the inside. Above the rollers 5 are the legs 14 of bent metal sheets which prevent the ropes 3 from escaping from the grooves of the rope rollers 5.

Figure 6:
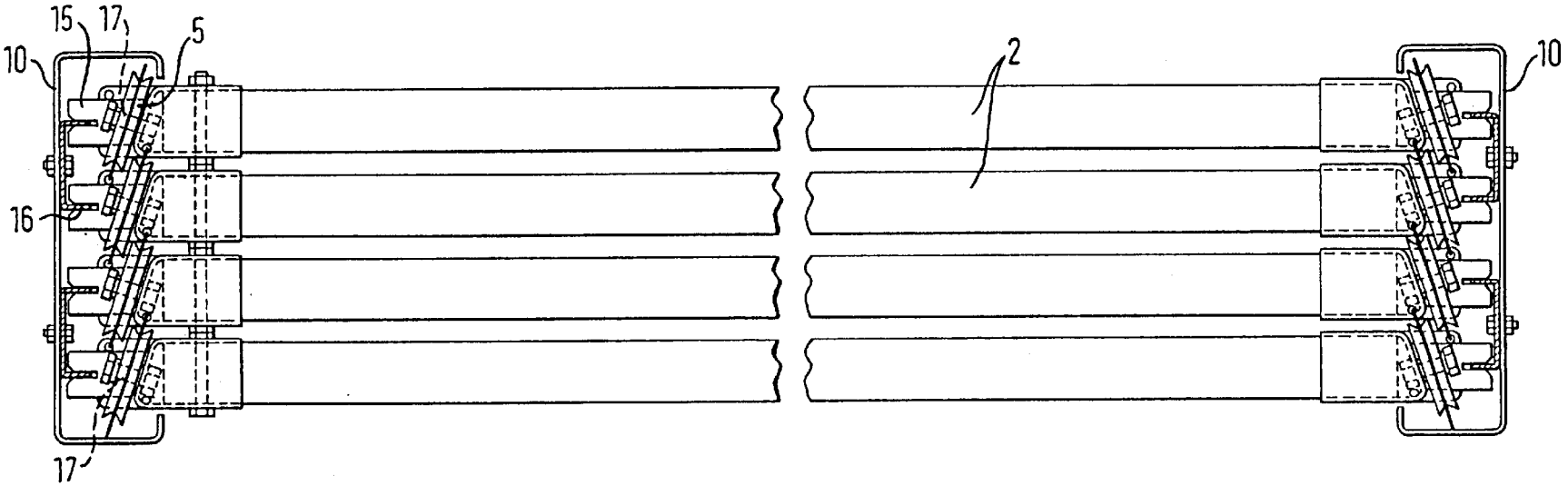
FIG. 6 shows a top view of another embodiment of the closing elements travellable in their guides.

In the embodiment of FIG. 6, there disposed on the upper and lower side end regions of the closing elements 2 slit slide blocks 15, whose slits encompass the legs of U-shaped sections 16 which are screwed to the side frame sections 10. Furthermore, the closing elements 2 are provided on their side upper end regions with oblique axles 17 on which the rollers 5 are freely pivoted. Thanks to this support of the rollers 5 on oblique axles, all closing elements 2 can be formed identically as the median planes of the rollers 5 are on planes parallel to one another in the manner visible from FIG. 6 so that the ropes 3 can cross without contact.

Figure 7:
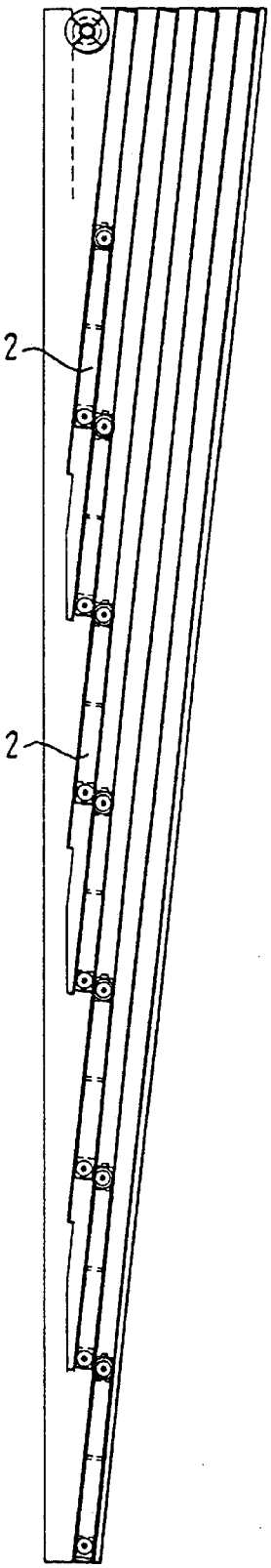
FIG. 7 shows a side view of the closing elements of FIG. 2 travelled in their guides into their closed positions in a schematic representation.

From FIG. 7, a side view of the guides for the closing elements 2 is visible in a schematic representation. The closing elements run over their rollers 12 in the guides disposed in parallel to one another which are formed, for example, by the legs 11 of the U sections.

Figure 8:
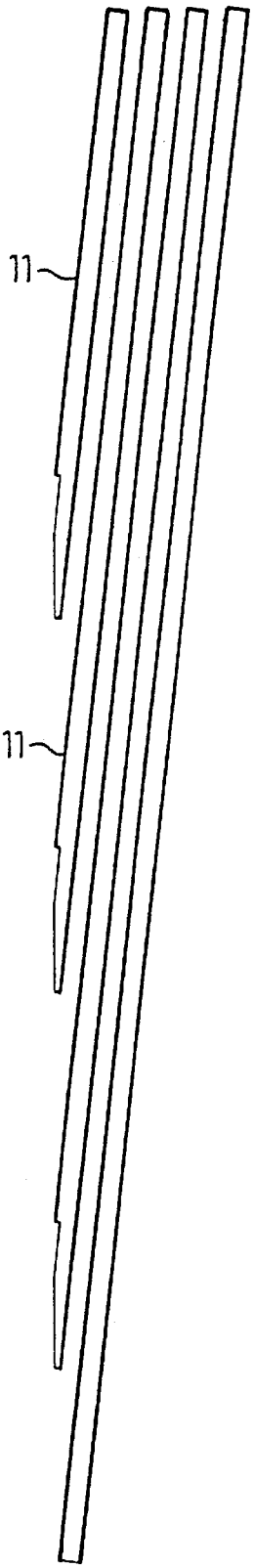
FIG. 8 shows the guides of FIG. 7 without the closing elements travellable in them.

From FIG. 8, the guides can be seen without the closing elements guided therein. As follows from FIG. 8, the U sections whose legs 11 form the guides only need to be designed in a stepped form to a length such as the closing elements are lowered as they travel to the closed position.

Figure 9:
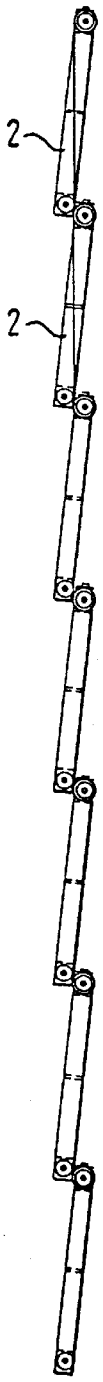
FIG. 9 shows the closing elements of FIG. 7 travelled into their closed position without the guides.

In FIG. 9, the individual closing elements are shown in the closed position without their guides. It follows from this representation that the closing elements lie like scales on top of one another in their closed position, with them overlapping only with their lower and upper end regions.

Figure 12:
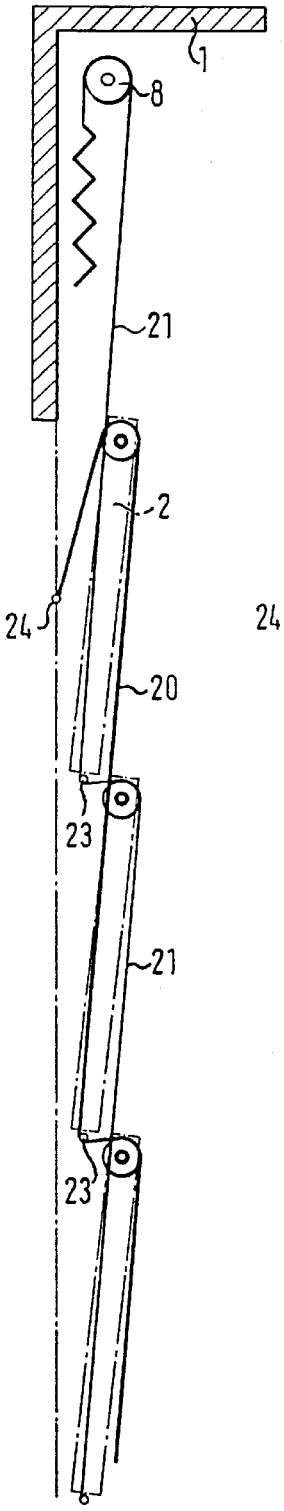
FIG. 12 shows a representation in accordance with FIGS. 10 and 11 in which the closing elements are travelled into their closed position.
Figure 11:
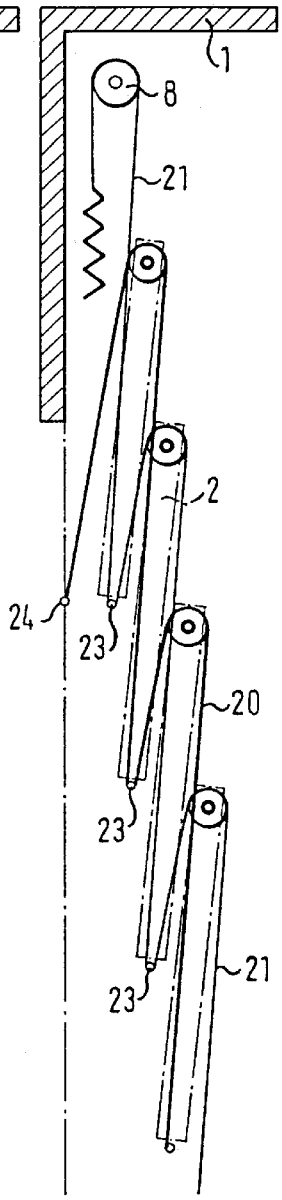
FIG. 11 shows a representation in accordance with FIG. 10 in which the closing elements are travelled into their semi-closed position.
Figure 10:
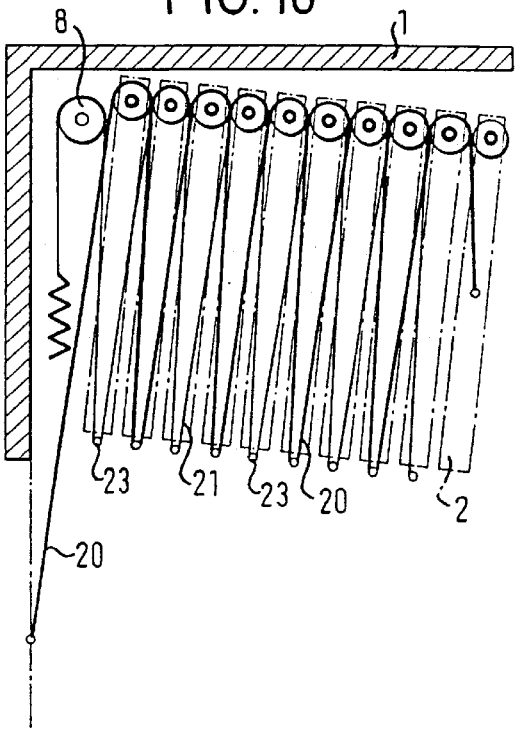
FIG. 10 shows a side view of a second embodiment of the closing elements of a door located in their open position in a schematic representation.

In the embodiment of FIGS. 10 to 12, the ropes 20, 21 connecting the closing elements 2 to one another and to the side part of the door construction consist of continuous ropes which are reversed via journals 23—which simultaneously form the fixed points—disposed in the lower region of the closing elements.

The upper strand side of the rope 21 is connected to the toothed belt which runs over the toothed belt pulley 8 of the geared motor.

Apart from the fact that the ropes 21, 22 are designed continuously, the type of edging into line corresponds to that described by means of FIG. 1 as the reversing journals 23 can be considered as a unification of the fixed points 4 and 6.

While the upper strand side of the rope 21 is connected to the toothed belt, the upper end of the rope 20 is held fixed to the door frame at point 24.

Figure 17:
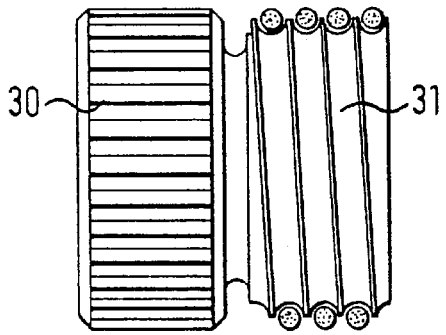
FIG. 17 shows a view of a first embodiment of a rope drum having rope coils disposed next to one another connected to a cogwheel.
Figure 18:
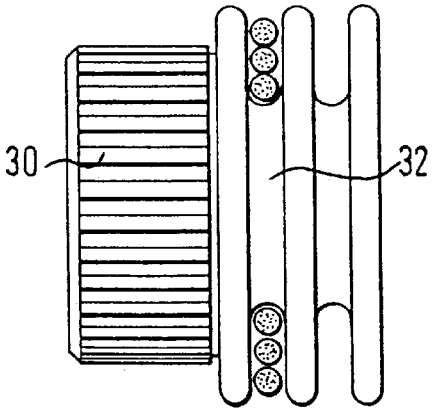
FIG. 18 shows a view of a second embodiment of a rope drum having rope coils disposed on top of one another connected to a cogwheel.
Figure 19:
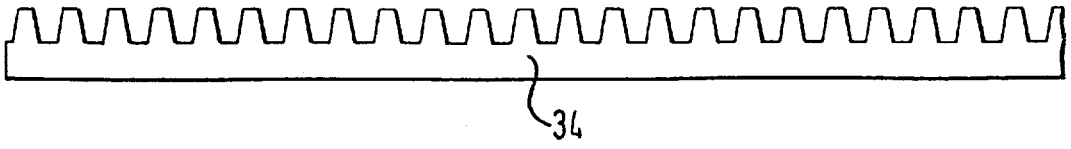
FIG. 19 shows a side view of a rack.

In the embodiment of FIGS. 13 to 16, there are freely pivoted on both sides in the upper region of the closing elements 2 cogwheels 30 which are provided in the manner visible from FIGS. 17 and 18 coaxially with rope drums 31, 32. The cogwheels 30 mesh with racks 34 of which the first is solidly connected in the manner visible from FIG. 13 to the side part of the door construction and the following ones to the closing elements 2.

On the rope drums 31, 32, there are wound ropes 35 fixed solidly with their upper ends thereto whose ends are fixed to the following closing elements 2 at the points 36. To the fixed point 37 of the upper closing element 2, there is fixed a rope 38 which is wound up on a rope drum 39 which is driven by a geared motor which effects the closing and opening of the door.

The closing elements 2 are guided in the manner described via rollers in lateral guides of the door sections as can be seen from FIGS. 15 and 16.

FIG. 14 shows the closing elements 2 in their open position in which they lie next to one another with a stack with aligning edges. From FIG. 15, the closing elements 2 can be seen in a position in which the door is half closed.

In FIG. 16 the door of FIGS. 13 to 15 is shown schematically in its closed position.

Figure 21:
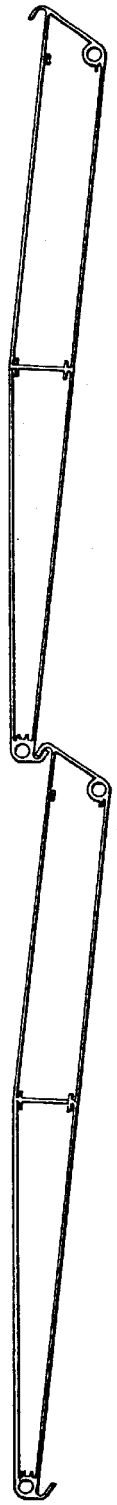
FIG. 21 shows a side view of two closing elements of FIG. 20 hooked into each other.
Figure 20:
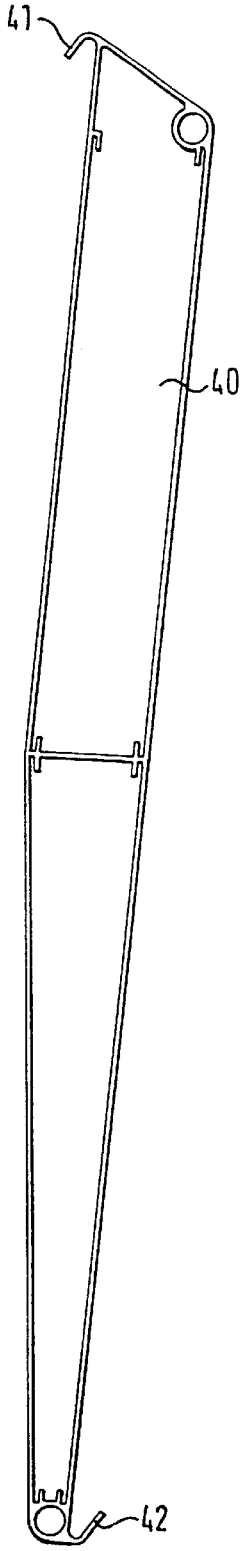
FIG. 20 shows a side view of a closing element.

From FIG. 20, a closing element 40 can be seen which consists of an extrusion section of plastic or metal. On the upper and lower ends of the closing element 40, there are disposed hook-shaped strips 41, 42 which can hook into one another in the closed position in the manner visible from FIG. 21 so that the closing elements cannot be pressed away from one another in their closed position and also lie next to one another in a sealing manner.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. A door opening and closing apparatus comprising:

a door frame having lateral door cross beams;

a plurality of substantially rectangular plate-shaped closing elements disposed horizontally and substantially parallel relative to one another, each closing element having longitudinal edges and lateral side edges, and said closing elements guided in a region of said lateral door cross beams and movable relative to one other from an upper position in which said closing elements lie next to each other roughly edgewise along said longitudinal edges in a stack with said lateral side edges substantially aligned, to a lowered position, into which said closing elements are traveled with decreasing overlapping length until only upper and lower edge sections of adjacent closing elements overlap;

a first flexible tension element for connecting an upper region of a first closing element to a lower region of a second closing element, said first tension element fixed at a first end to said door frame;

a drive mechanism for moving said first closing element at a first rate relative to said frame while said second closing element, connected to said first closing element, is moved at a second rate relative to said first closing element, said second rate being faster than said first rate such that, when being raised, said first and second closing elements reach said upper position substantially simultaneously.

2. The door opening and closing apparatus as set forth in claim 1 wherein said drive mechanism is connected only to said first closing element.

3. The door opening and closing apparatus as set forth in claim 1, further comprising:

a guide pulley in said upper region of said first closing element, said first tension element passing over said guide pulley.

4. The door opening and closing apparatus as set forth in claim 1, wherein said drive mechanism includes one of a toothed belt and a chain which runs over a sprocket of a geared motor, said one of a toothed belt and a chain connected to a spring in a fixed connection to the door frame such that said spring is increasingly tightened as the closing elements are moved to said lowered position.

5. The door opening and closing apparatus as set forth in claim 1, wherein top and bottom regions of said lateral side edges of said plurality of closing elements include rollers, and said lateral door cross beams include guides, said rollers being guided in said guides as said closing elements are moved up and down.

6. The door opening and closing apparatus as set forth in claim 5, wherein said guides include metal sheets running substantially parallel to one another, neighboring sheets forming guides for the rollers of a respective closing element.

7. The door opening and closing apparatus as set forth in claim 1, wherein top and bottom regions of said lateral side edges of said plurality of closing elements include slide blocks, and said lateral door cross beams include slide rails, said slide blocks being guided in said slide rails as said closing elements are moved up and down.

8. The door opening and closing apparatus as set forth in claim 1, wherein top and bottom regions of said lateral side edges of said plurality of closing elements include slide blocks having slits, and said lateral door cross beams include guide bars, said slits encompassing said guide bars and said slide blocks being guided thereby as said closing elements are moved up and down.

9. The door opening and closing apparatus as set forth in claim 1, wherein said closing elements are extruded sections.

10. The door opening and closing apparatus as set forth in claim 9, wherein said closing elements include, along said longitudinal edges, strips shaped as opposing hooks to hook into one another in the lowered position.

11. The door opening and closing apparatus as set forth in claim 1, further comprising:

a second flexible tension element for connecting a lower region of said first closing element to an upper region of said second closing element, said second tension element fixed at a first end to said lower region of said first closing element and connected at a second end to a lower region of a third closing element, said third closing element being moved by said second closing element at a third rate which is faster than said second rate such that, when being raised, said second and third closing elements reach said upper position substantially simultaneously.

12. The door opening and closing apparatus as set forth in claim 11, wherein said drive mechanism is only connected to said first closing element.

13. The door opening and closing apparatus as set forth in claim 11, further comprising:

a third flexible tension element for connecting a lower region of said second closing element to an upper region of said third closing element, said third tension element fixed at a first end to said lower region of said second closing element and connected at a second end to a lower region of a fourth closing element, said fourth closing element being moved by said third closing element at a fourth rate which is faster than said third rate such that, when being raised, said third and fourth closing elements reach said upper position substantially simultaneously.

14. The door opening and closing apparatus as set forth in claim 11, wherein beginning from a second fixed point of said third closing element, an identical edging into line of flexible tension elements, but in an opposite direction, is provided.

15. The door opening and closing apparatus as set forth in claim 14, wherein the closing elements are edged into line for traveling in two directions opposite to each other and are also disposed in a standing position on their side edges so that the closing elements can be moved beginning from one door side to a second door side or beginning from both door sides toward and away from each other.

16. The door opening and closing apparatus as set forth in claim 11, further comprising:

a first guide pulley in said upper region of said first closing element and a second guide pulley located in said upper region of said second closing element, said first tension element passing over said first guide pulley and said second tension element passing over said second guide pulley.

17. The door opening and closing apparatus as set forth in claim 16, wherein said first and second guide pulleys are supported offset from one another, from one closing element to an adjacent closing element, on journals connected to said lateral side edges of said closing elements.

18. The door opening and closing apparatus as set forth in claim 16, wherein said first and second guide pulleys are supported on oblique axles connected to said lateral side edges of said closing elements.

19. The door opening and closing apparatus as set forth in claim 1, further comprising:

a second flexible tension element for connecting a lower region of said first closing element to an upper region of said second closing element, said second tension element connected at a first end to said drive mechanism and connected at a second end to a lower region of a third closing element, said third closing element being moved by said second closing element at a third rate which is faster than said second rate such that, when being raised, said second and third closing elements reach said upper position substantially simultaneously.

20. The door opening and closing apparatus as set forth in claim 19, further comprising:

a first guide pulley in said upper region of said first closing element and a second guide pulley located in said upper region of said second closing element, said first tension element passing over said first guide pulley and said second tension element passing over said second guide pulley.

21. The door opening and closing apparatus as set forth in claim 20, wherein said first and second tension elements run in a crossing manner over said guide pulleys and are reversed over journals fixed in said lower regions of the lateral side edges of said closing elements.

22. The door opening and closing apparatus as set forth in claim 20, further comprising a third guide pulley in an upper region of said third closing element, said first tension element running over said third guide pulley to a lower region of a fourth closing element, said first and second tensions elements running in a crossing manner over said guide pulleys and being reversed over journals fixed in said lower regions of the lateral side edges of said closing elements.

23. A door opening and closing apparatus comprising:

a door frame having lateral door cross beams;

a plurality of substantially rectangular plate-shaped closing elements disposed horizontally and substantially parallel relative to one another, each closing element having longitudinal edges and lateral side edges, and said closing elements guided in a region of said lateral door cross beams and movable relative to one other from an upper position in which said closing elements lie next to each other roughly edgewise along said longitudinal edges in a stack with said lateral side edges substantially aligned, to a lowered position, into which said closing elements are traveled with decreasing overlapping length until only upper and lower edge sections of adjacent closing elements overlap;

a first flexible tension element for connecting an upper region of a first closing element to a lower region of a second closing element, said first tension element fixed at a first end to said door frame;

a second flexible tension element for connecting a lower region of said first closing element to an upper region of said second closing element, said second tension element fixed at a first end to a lower region of said first closing element and connected at a second end to a lower region of a third closing element;

a drive mechanism connected only to said first closing element for moving said first closing element at a first rate relative to said frame while said second closing element, connected to said first closing element, is moved at a second rate relative to said first closing element, said second rate being faster than said first rate, said third closing element being moved by said second closing element at a third rate which is faster than said second rate such that, when being raised, said first, second and third closing elements reach said upper position substantially simultaneously.

24. The door opening and closing apparatus as set forth in claim 23, further comprising:

first and second guide pulleys in said upper regions of said first and second closing elements, respectively, said first tension element passing over said first guide pulley and said second tension element passing over said second guide pulley.

25. The door opening and closing apparatus as set forth in claim 24, wherein said first and second guide pulleys are supported offset from one another, from one closing element to an adjacent closing element, on journals connected to said lateral side edges of said closing elements.

26. The door opening and closing apparatus as set forth in claim 24, wherein said first and second guide pulleys are supported on oblique axles connected to said lateral side edges of said closing elements.

27. The door opening and closing apparatus as set forth in claim 23, wherein said upper regions of said closing elements include cogwheels having coaxial winding drums for said flexible tension elements, a first cogwheel on said first closing element meshing with a rack in a fixed position on the door frame, and a second cogwheel on said second closing element meshing with a rack fixed to said first closing element.

28. The door opening and closing apparatus as set forth in claim 27, wherein each winding drum has a spiral winding groove and a diameter substantially equivalent to a pitch diameter of said cogwheels.

29. The door opening and closing apparatus as set forth in claim 28, wherein each winding drum has lateral limit washers between which a respective flexible tension element is wound up in spiral fashion and a center of a height of the winding groove is roughly at a height of the pitch of the cogwheels.

* * * * *